US008702387B2

(12) United States Patent
Gillette

(10) Patent No.: US 8,702,387 B2
(45) Date of Patent: Apr. 22, 2014

(54) PROPULSION SYSTEM

(75) Inventor: Peter J. Gillette, Moorpark, CA (US)

(73) Assignee: Vision Aquatics, Inc., Moorpark, CA (US)

( * ) Notice: Subject to any disclaimer, the term of this patent is extended or adjusted under 35 U.S.C. 154(b) by 516 days.

(21) Appl. No.: 12/941,506

(22) Filed: Nov. 8, 2010

(65) Prior Publication Data

US 2011/0110775 A1 May 12, 2011

Related U.S. Application Data

(60) Provisional application No. 61/258,701, filed on Nov. 6, 2009.

(51) Int. Cl.
*F04D 29/52* (2006.01)

(52) U.S. Cl.
USPC ..... 415/221; 415/211.2; 415/210.1; 366/337; 4/904

(58) Field of Classification Search
USPC ..... 4/507, 509, 904; 415/220, 221, 228, 415/211.2, 914, 191, 210.1; 416/189, 416/245 R; 417/540, 542; 138/39, 42, 37, 138/40, 44; 366/336, 337
See application file for complete search history.

(56) References Cited

U.S. PATENT DOCUMENTS

| | | | | |
|---|---|---|---|---|
| 930,613 | A | | 8/1909 | Pressy |
| 1,331,270 | A | | 2/1920 | Lippincott |
| 1,630,797 | A | | 5/1927 | Marwick |
| 1,731,554 | A | | 10/1929 | Wheeler |
| 1,971,386 | A | * | 8/1934 | Schmidt ..... 415/201 |
| 2,035,835 | A | | 3/1936 | Raber |
| 3,203,352 | A | | 8/1965 | Schafranek |
| 3,287,741 | A | | 11/1966 | Nash |
| 3,345,982 | A | | 10/1967 | Guiler |
| 3,534,413 | A | | 10/1970 | Plassermud |
| 3,577,571 | A | | 5/1971 | Bellinson et al. |
| 3,605,131 | A | | 9/1971 | Brazel et al. |
| 3,977,027 | A | | 8/1976 | Speck |
| 4,308,755 | A | * | 1/1982 | Millar et al. ..... 73/861.77 |
| 4,352,215 | A | | 10/1982 | Laing |
| 4,665,572 | A | | 5/1987 | Davidson et al. |
| 4,907,304 | A | | 3/1990 | Davidson et al. |
| 5,005,228 | A | | 4/1991 | Mermelstein |
| 5,186,578 | A | | 2/1993 | Perslow |
| 5,207,729 | A | | 5/1993 | Hatanaka |
| 5,226,747 | A | | 7/1993 | Wang et al. |
| 5,298,003 | A | | 3/1994 | Weihe et al. |
| 5,478,208 | A | | 12/1995 | Kasai et al. |
| 5,597,288 | A | | 1/1997 | Hatanaka |
| 5,662,558 | A | | 9/1997 | Shannon, III |
| 6,030,180 | A | | 2/2000 | Clarey et al. |
| 6,789,278 | B2 | | 9/2004 | Shea |
| 7,526,820 | B2 | | 5/2009 | Murdock et al. |

* cited by examiner

*Primary Examiner* — Edward Look
*Assistant Examiner* — Juan G Flores
(74) *Attorney, Agent, or Firm* — Frederick J. M. Price; George R. McGuire

(57) ABSTRACT

The present invention relates generally to propulsion systems, and, more particularly, to a propulsion system including an axial flow water pump assembly and a laminar flow box assembly for generating a streamline laminar slipstream of water velocity that is used in aquatic therapy, aquatic sport fitness rehabilitation, aquatic rehabilitation, swimming, and a variety of other functional therapy and training modalities.

20 Claims, 13 Drawing Sheets

(a)

SECTION A-A
(b)

7 - 9

(a)

(b)

12 x 12 FLOWBOX W/ GRATES

3 HP

| HZ | MPH | GPM |
|---|---|---|
| 0 | 0.0 | 0 |
| 10 | 0.8 | |
| 15 | 2.4 | |
| 20 | 3.4 | |
| 25 | 3.9 | |
| 30 | 5.0 | |
| 35 | 5.5 | |
| 40 | 6.6 | |
| 45 | 7.8 | |
| 50 | 9.0 | |
| 55 | 9.8 | |
| 60 | 10.5 | |
| 63 | 11.3 | |

5 HP

| | MPH | GPM |
|---|---|---|
| 0 | 0.0 | 0 |
| 10 | 1.1 | |
| 15 | 2.8 | |
| 20 | 3.9 | |
| 25 | 4.5 | |
| 30 | 5.7 | |
| 35 | 6.1 | |
| 40 | 7.3 | |
| 45 | 9.3 | |
| 50 | 10.5 | |
| 55 | 11.2 | |
| 60 | 12.6 | |
| 63 | 13.2 | |

7.5 HP

| HZ | MPH | GPM |
|---|---|---|
| 0 | 0.0 | 0 |
| 10 | 1.5 | |
| 15 | 3.8 | |
| 20 | 4.8 | |
| 25 | 5.6 | |
| 30 | 7.0 | |
| 35 | 7.5 | |
| 40 | 10.1 | |
| 45 | 11.3 | |
| 50 | 13.2 | |
| 55 | 14.1 | |
| 60 | 16.1 | |
| 63 | 16.7 | |

THERASTREAM W/GRATES

3 HP

| HZ | MPH | GPM |
|---|---|---|
| 0 | 0.0 | 0 |
| 10 | 0.4 | 163 |
| 15 | 1.0 | 477 |
| 20 | 1.5 | 679 |
| 25 | 1.7 | 791 |
| 30 | 2.2 | 1014 |
| 35 | 2.4 | 1104 |
| 40 | 2.8 | 1322 |
| 45 | 3.4 | 1560 |
| 50 | 3.9 | 1810 |
| 55 | 4.2 | 1961 |
| 60 | 4.6 | 2112 |
| 63 | 4.9 | 2263 |

5 HP

| HZ | MPH | GPM |
|---|---|---|
| 0 | 0.0 | 0 |
| 10 | 0.5 | 223 |
| 15 | 1.2 | 567 |
| 20 | 1.7 | 785 |
| 25 | 1.9 | 896 |
| 30 | 2.5 | 1141 |
| 35 | 2.6 | 1225 |
| 40 | 3.2 | 1463 |
| 45 | 4.0 | 1865 |
| 50 | 4.5 | 2103 |
| 55 | 4.8 | 2245 |
| 60 | 5.4 | 2529 |
| 63 | 5.7 | 2655 |

7.5 HP

| HZ | MPH | GPM |
|---|---|---|
| 0 | 0.0 | 0 |
| 10 | 0.7 | 302 |
| 15 | 1.6 | 754 |
| 20 | 2.1 | 957 |
| 25 | 2.4 | 1132 |
| 30 | 3.0 | 1409 |
| 35 | 3.3 | 1509 |
| 40 | 4.4 | 2031 |
| 45 | 4.9 | 2263 |
| 50 | 5.7 | 2652 |
| 55 | 6.1 | 2830 |
| 60 | 7.0 | 3247 |
| 63 | 7.2 | 3364 |

PROPULSION SYSTEM

RELATED APPLICATION DATA

The present application claims benefit of U.S. provisional patent application No. 61/258,701, filed Nov. 6, 2009, and is hereby incorporated by reference in its entirety.

BACKGROUND OF THE INVENTION

1. Field of Invention

The present invention relates generally to propulsion systems, and, more particularly, to a propulsion system including an axial flow water pump assembly and a laminar flow box assembly adapted to generate a variable speed streamline laminar slipstream of water current with a variety of water velocities and thrusts that can be used in aquatic therapy, aquatic sport fitness rehabilitation, aquatic rehabilitation, swimming, sports medicine, and a variety of other functional therapy and training modalities.

2. Description of the Related Art

Propulsion systems with axial flow pumps used in conjunction with swimming pools and the like are conventional. For example, companies such as SwimGym, Inc. ("SwimGym") and Riverflow Pumps by Current-Systems. Inc. ("RiverFlow") provide such systems, as should be appreciated by those skilled in the art. These systems include a pump body that is a 10" PVC tee pipe fitting with a boat propeller, a propeller shaft, water bearing and a seal on the top of the tee. These systems also have a 10" diameter inlet line to the pool and a variety of grate configurations from a 10" diameter to a 10" by 12" square. The main difference between these two companies' products is that the SwimGym product is driven with a shaft pulley, a v-belt and a motor pulley, while the Riverflow product is driven by a direct drive prop shaft to motor shaft configuration.

Other conventional propulsion systems include systems produced by SwimEx, Inc. ("SwimEx") and Badu, as should be appreciated by those skilled in the art. Swimex has designed a propulsion system that includes a paddlewheel that is contained in a section attached to one end of a pool. The previously patented system includes a series of paddles mounted on a shaft that is driven by a direct drive gearbox assembly and either a 5 H.P. or 7½ H.P. motor. This system creates a 4 ft. wide turbulent flow from the paddlewheel. Speck Pump, Inc. makes an aerated system that is called the "Badu Jet." and "Badu Stream II". This system uses up to a centrifugal 4 H.P. pump, which drives the water through a jet nozzle at a rate up to 325 GPM and is located on an assembly on the end of a pool. Due to its venturi action, this system introduces air into the water stream to increase velocity.

As should be appreciated by those skilled in the art, many other companies use spa or swim jets, which they call propulsion systems. However, like the Badu Jet, these systems use aerated or air assisted venturi type jets.

Description of the Related Art Section Disclaimer: To the extent that specific publications/devices/products are discussed above in this Description of the Related Art Section, these discussions should not be taken as an admission that the discussed publications/devices/products are prior art for patent law purposes. For example, some or all of the discussed publications/devices/products may not be sufficiently early in time, may not reflect subject matter developed early enough in time and/or may not be sufficiently enabling so as to amount to prior art for patent law purposes. To the extent that specific publications/devices/products are discussed above in this Description of the Related Art Section (as well as throughout the application), they are all hereby incorporated by reference into this document in their respective entirety(ies).

SUMMARY OF THE INVENTION

The present invention recognizes that there are potential problems and/or disadvantages in the above-discussed conventional propulsion systems. One of the problems associated with the conventional propulsion systems such as the SwimGym and the RiverFlow arises when water is pushed through a tee fitting. This causes a tremendous amount of turbulence and cavitation, thus greatly reducing the efficiency of the pump limiting their water flow to an approximate maximum of 2500 GPM for a 10 H.P. motor (Riverflow only), 2100 GPM for a 7½ HP motor, and 1800 GPM for a 5 H.P. motor. Another contributor to the inefficiency of these conventional propulsion systems is the propeller. In both product lines the propeller is akin to a modified boat propeller with a large 4" hub and disproportionally small blades. Also the pitch of the prop blade is inefficient due to its 10" pitch angle, which also limits the maximum propeller RPM's to 1150. The motors included in these conventional systems are typically rated at 1760 RPM at 60 hertz, but due to all of the inefficiencies mentioned above they are only capable of attaining about 65% efficiency. Potential problems related to other conventional propulsion systems include the causation of turbulence and distortion of water current in systems that introduce air or are air assisted. Various embodiments of the present invention may be advantageous in that they may solve or reduce one or more of the potential problems and/or disadvantages discussed in this paragraph.

It is therefore a principal object and an advantage of the present invention to provide a propulsion system for therapy pools, fitness pools, and any other swimming and/or spa modalities that is structured to be more energy efficient, to produce at least 30% to 40% more current velocity and gallons per minute of water (GPM), and is more durable than conventional propulsion systems.

It is a further object and advantage of the present invention to provide a propulsion system that does not introduce air and is not air assisted.

It is an additional object and advantage of the present invention to provide a propulsion system that is structured to provide at least partial laminar water flow, and preferably pure laminar water flow.

In accordance with the foregoing objects and advantages of the present invention, an embodiment of the present invention provides a propulsion system including an axial flow water pump assembly and a laminar flow box assembly.

In accordance with an embodiment of the present invention, the axial flow water pump assembly includes, but is not limited to a axial vane flow straightener, a variable frequency motor drive and an AC three phase motor (a variety of motor drives and motors are contemplated to allow for a large range of variable speed torques and power). The variable frequency motor drive and AC or D/C three phase motors can be used singularly or in multiples in sizes of, e.g., 2 HP, 3 HP, 5 HP, 7½ HP, or 10 HP. The variable frequency motor drive is structured to move a flow of water at variable speeds per minute (e.g., from one gallon up to 4,000 gallons per minute or greater in multiple pump assemblies). The axial flow water pump assembly can be a 10" sweep 90 fitting. The axial flow water pump assembly can employ a stainless steel drive shaft, and ducted propeller (e.g., Kaplan style propeller that was engineered for maximum efficiency with about an 8" blade pitch and less than 4" hub, preferably less than 2" hub; The blade root (attachment area of blade to hub) of the propeller can have has a twist of 2" radially over a 1.75" longitudinal height to the hub root. The range of the dimensions that are most preferrable for the twist in the above is: ½" to 4" twist radially over a 1" to 6" longitudinal height of the hub that can be constructed with hydrolysis and chemical resistant materials. The blades of the propeller can be structurally non-planar, designed with twists along the length so as to allow radial flow at the entry and axial flow/thrust at the exit. This design allows for a more efficient axial flow water pump assembly (and is the more efficient way to drive water, as compared with the related arts use of a boat propeller).

For example, the axial flow water pump can be designed with a Kaplan-type fixed vane propeller configured within the unique pump body (which is bent at about its center at about 90°, as shown and discussed in the Detailed Description section below, and Figures) as a ducted drive turbine. This ducted drive turbine design produces positive water thrust and greater pump efficiencies. This ducted design incorporates highly precise mechanical tolerances to keep pump slippage to a maximum of 15% and uses a 7.5" to 9.5" blade pitch. This pump is designed to operate with a flooded suction, low head pressures, and high water flow. The Kaplan-type propeller design produces a mix of radial and axial flow features with greatly reduced blade tip vortexing for more efficiency. The water flow exiting the ducted propeller creates a vortex that is greatly reduced or eliminated by the placement of the axial vane flow straightener that is incorporated in the effluent end of the pump body. The drive shaft can be driven by a pulley system, drive belt, and A/C or D/C electric motor. Alternately the drive shaft can be driven by a direct drive three phase AC motor and spider coupling assembly. The axial flow water pump assembly can also include a axial vane flow straightener (as mentioned above), uniquely designed seal carrier based on the unique shape of the pump body, motor frame mounts and plate, bearings and a seal at shaft penetration and a Van Stone PVC flange on the two ends to allow for easy installation, removal and repair. Additionally, the axial flow water pump assembly can include a cogg belt shaft pulley, a cogg belt motor pulley and a cogg belt for up to 100% positive drive efficiency with no belt slippage. The axial flow water pump assembly is structured to initially direct water through the axial vane flow straightener to correct the axial rotation of the water downstream of the propeller (water enters radially to the propeller, and exits the propeller axially to the axial vane flow straightener). The axial flow water pump assembly is also structured to spin the drive shaft up to the motors maximum speed (e.g., 1760 RPM at 60 Hertz).

In accordance with an embodiment of the present invention, the laminar flow box assembly is structured to be mechanically connected (either directly or indirectly) to the axial flow pump assembly and receive turbulent water flow from the axial flow pump assembly. The laminar flow box assembly can include, but is not limited to, at least one ramp laminator, and preferably a plurality of specifically spaced and sized flow laminators located on the interior of the assembly (e.g., top and bottom of the laminar flow box assembly which run the width of the assembly) to quiet the turbulence and spread the flow of water evenly so that the flow exiting the box is a clear laminar slipstream of water. The laminators are used to give a consistent velocity of flow current for aquatic therapy and aquatic sports fitness training throughout the opening of the assembly. The number of ramp laminators required to provide a consistent velocity of flow per box can be dependent upon the width of the particular flow box. For example a 32" wide laminar flowbox can require four sets of ramp laminators that are internally mirrored from the top and bottom of the flowbox whereas a 24" laminar flowbox can require three sets of ramp laminators that are internally mirrored from the top and bottom of the flowbox. Accordingly, in use, the water flow from the axial flow pump assembly enters the laminar flow box assembly at the velocity that is directed toward it. Upon entering the laminar flow box assembly, water passes through a series of ramp laminators, which through turbulent actions spread the flow of water and water pressures to evenly distribute the water velocity. Upon exiting grates of the laminar flow box assembly in a pool, the water velocity is a streamline laminar slipstream of water. The laminar flow box assembly can be arranged in a variety of orientations, positions and configurations (singularly or in multiple). Multiple laminar flow box assemblies can be used in a variety of combinations with various power ranges and flow box sizes.

The laminar flow box assemblies can be, for example, 12" by 12", 10" by 24", and 10" by 32" with single pump assemblies or 10" by 48", 10" by 64", 10" by 72" and 10" by 96" with multiple pump assemblies or greater at their outlets to the body of the pool. The laminar flow box assemblies can be structured to create at least a partially pure (preferably a truly pure) laminar slipstream with equal velocity throughout the laminar flow box assemblies to the openings/outlet into the pool.

BRIEF DESCRIPTION OF THE DRAWINGS

The present invention will be more fully understood and appreciated by reading the following Detailed Description in conjunction with the accompanying drawings, in which.

DETAILED DESCRIPTION

Reference will now be made in detail to the present preferred embodiments of the invention, examples of which are illustrated in the accompanying drawings.

Figure 1:
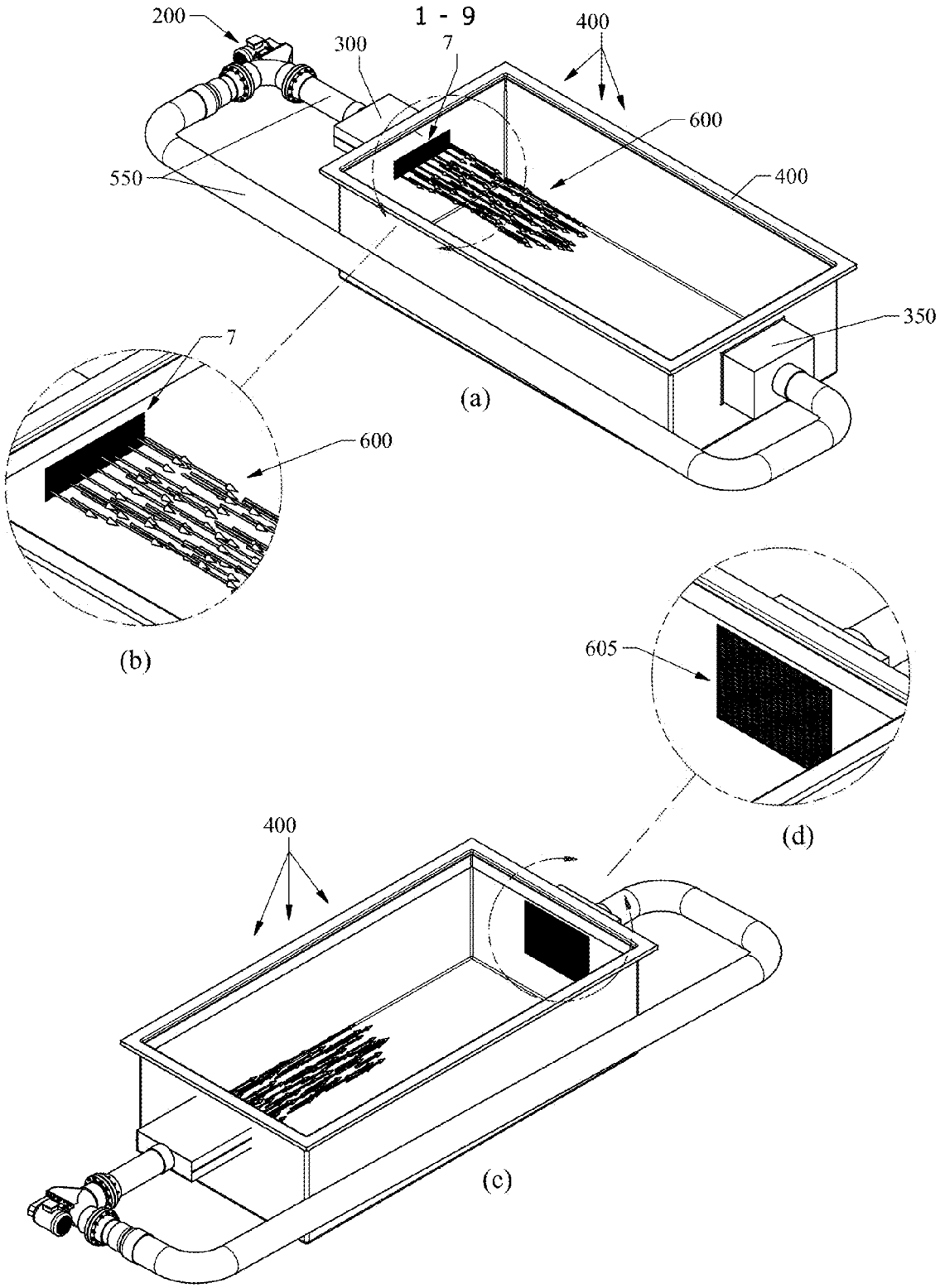
FIGS. 1*a-d* show various views and details of the propulsion system in a pool wall mount application according to an embodiment of the present invention.

FIGS. 1*a-d* show various views and details of the propulsion system 100 in a pool wall mount application according to an embodiment of the present invention. A pool 400 is shown with the laminar flow box assembly 300 attached thereto. An outlet grate 7 of the laminar flow box assembly 300 is shown in the inside of the pool 400. FIG. 1*a* shows arrows depicting laminar water flow 600 coming from the outlet grate 7 of the laminar flow box assembly 300 toward the suction/return box 350. The suction/return grate 605 is secured to the suction/return box 350 (by fasteners, adhesives or mechanical means). The suction/return grate 605 can be a safety grate that is designed to meet or exceed ASME A112.19.8 2008 standard for unblockable main drain covers as per the requirements for the Virginia Graham Baker Pool and Spa Safety Act as regulated by the U.S. Consumer Products Safety Commission. The suction/return box 350 is shown attached to pipe (e.g., 12" PVC pipe) and fittings 550, which is shown coupled to the axial flow water pump assembly 200, then to additional PVC pipe (e.g., 10") 550 which is attached to the PVC inlet coupler 2 (not shown) of the laminar flow box assembly 300.

Figure 2:
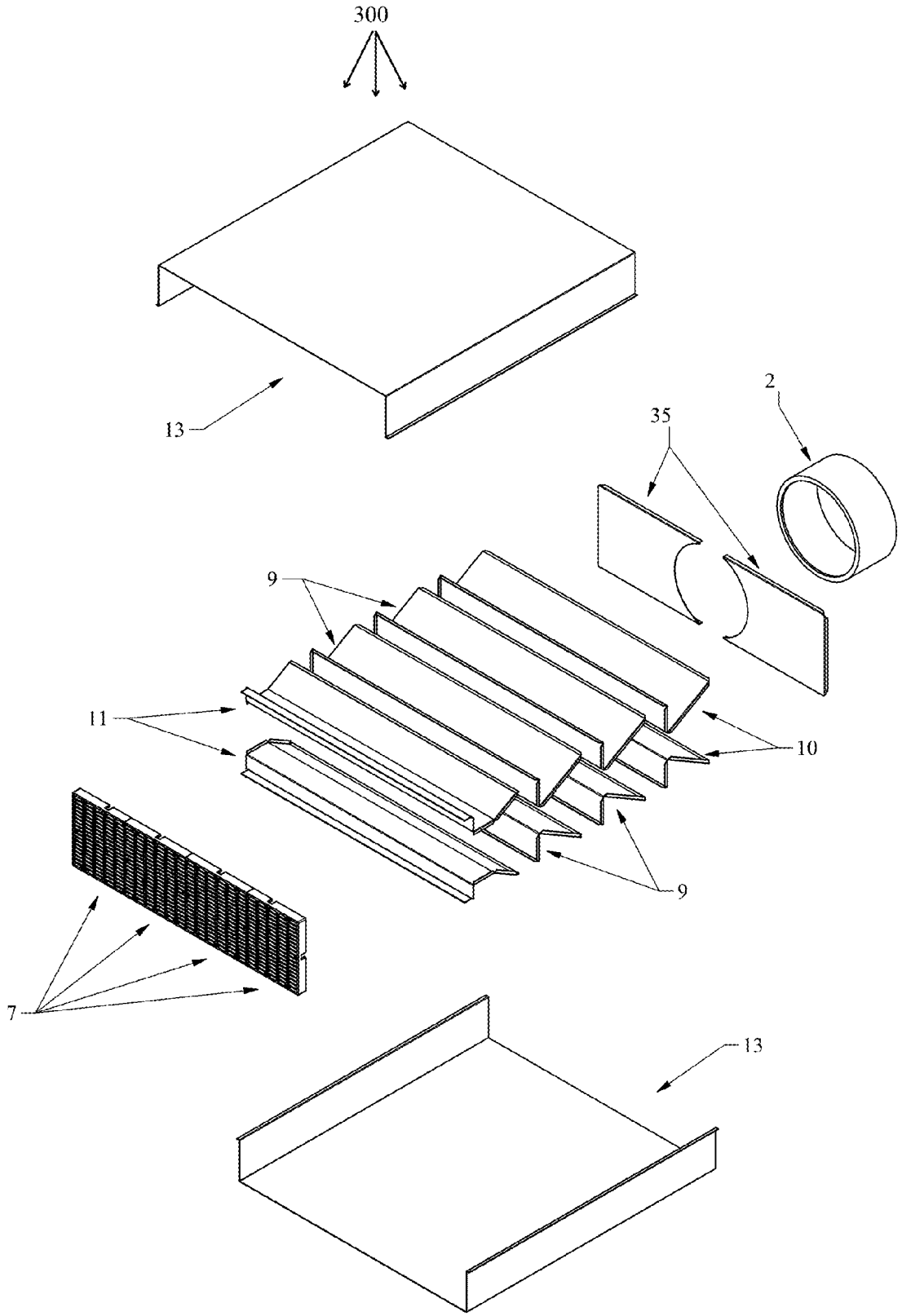
FIG. 2 shows an exploded view of the laminar flow box assembly according to an embodiment of the present invention.
Figure 3:
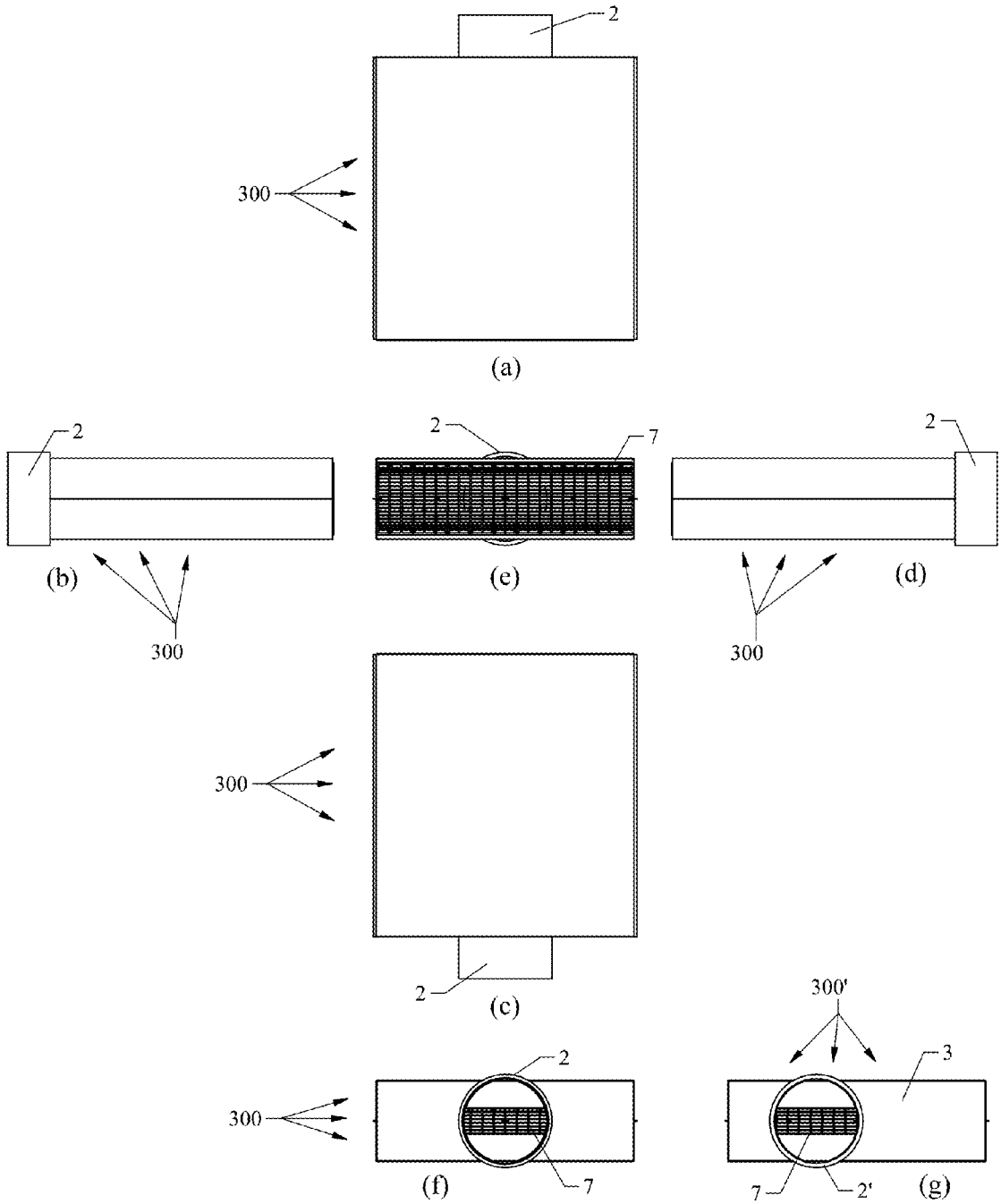
FIG. 3*a-g* show various views of the laminar flow box assembly including top and bottom views, left and right views, inlet and outlet views, and an offset view, according to an various embodiments of the present invention.

FIG. 2 shows an exploded view of the laminar flow box assembly 300 according to an embodiment of the present invention. Individual components of the laminar flow box assembly 300 shown in FIG. 2 are include, but are not limited to, ramp laminators 9, ramp laminators 10, ramp laminators 11, grates 7, rear enclosure 35, enclosure 13, and half coupler 2. Other preferred details and specifications regarding these individual components are illustrated and listed in FIG. 2 in the parlance of mechanical assembly drawings. The enclosures form a shell 13 (as shown in FIG. 3), which can be made of a variety of materials including fiberglass, steel, or sheet plastic for containing the flow laminators.

FIGS. 3*a-g* show various views of a preferred embodiment of the laminar flow box assembly 300 and 300' including top and bottom views, left and right views, inlet and outlet views, and an offset view, according to an embodiment of the present invention. These views show various parts of the laminar flow box assembly 300 including the shell 13, the PVC inlet coupler 2, and the outlet grate 7. FIG. 3*g* shows an offset outlet 2', offset outlet back enclosure 3, and grate 7.

Figure 4:
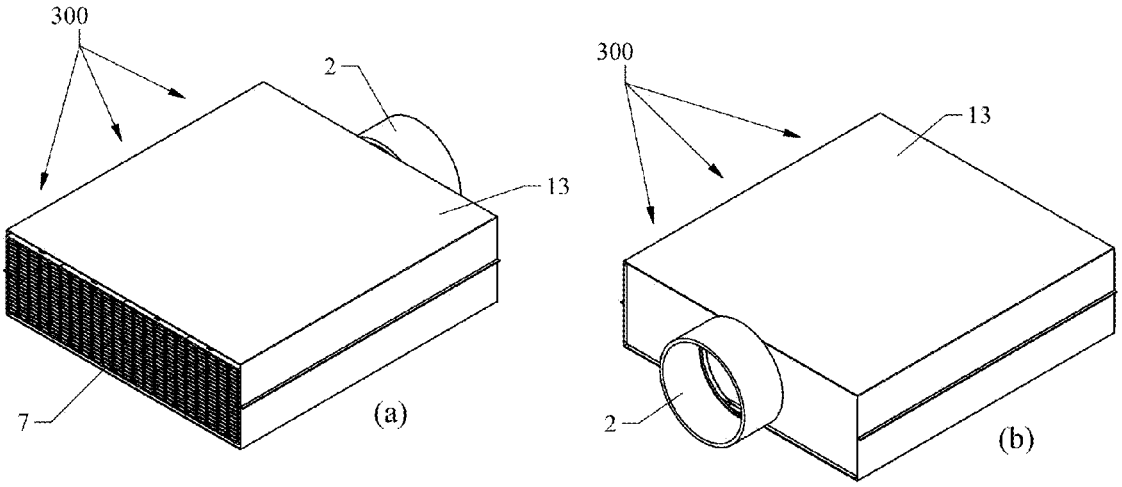
FIGS. 4*a-b* show a front right view and a back left view, respectively, of the laminar flow box assembly according to an embodiment of the present invention.

FIGS. 4*a-b* show a front right view and a back left view, respectively, of a preferred embodiment of the laminar flow box assembly 300 according to an embodiment of the present invention. FIG. 4*a* shows the shell 13, the PVC inlet coupler 2, and the outlet grate 7. FIG. 4*b* shows the shell 13, and the PVC inlet coupler 2.

Figure 5:
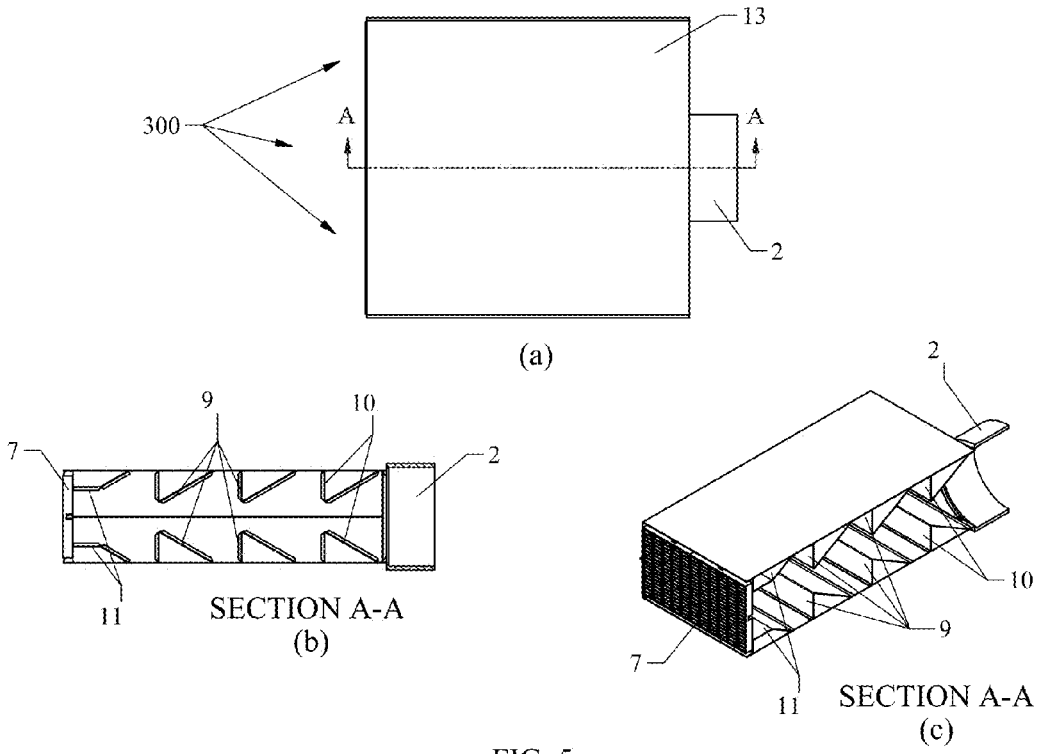
FIGS. 5*a-c* show various views of the laminar flow box assembly according to an embodiment of the present invention.

FIGS. 5*a-c* show various views of a preferred embodiment of the laminar flow box assembly 300 according to an embodiment of the present invention. FIG. 5*a* shows a top view of the laminar flow box assembly 300 with the shell 13, and the PVC inlet coupler 2. FIG. 5*b* shows a right side cutaway view of the laminar flow box assembly 300 along A-A of FIG. 5*a*. Top and bottom ramp laminators 9 (4 in total), top and bottom ramp laminators 10 (2 in total), top and bottom ramp laminators 11 (2 in total), the PVC inlet coupler 2, and the outlet grate 7 are shown. FIG. 5*c* shows a front right side cutaway view of the laminar flow box assembly 300 along A-A of FIG. 5*a*. Top and bottom ramp laminators 9, 10, and 11 are shown running the entire width of the laminar flow box assembly 300. Top enclosure of shell 13 is shown in phantom. The PVC inlet coupler 2, and the outlet grate 7 are also shown.

Figure 6:
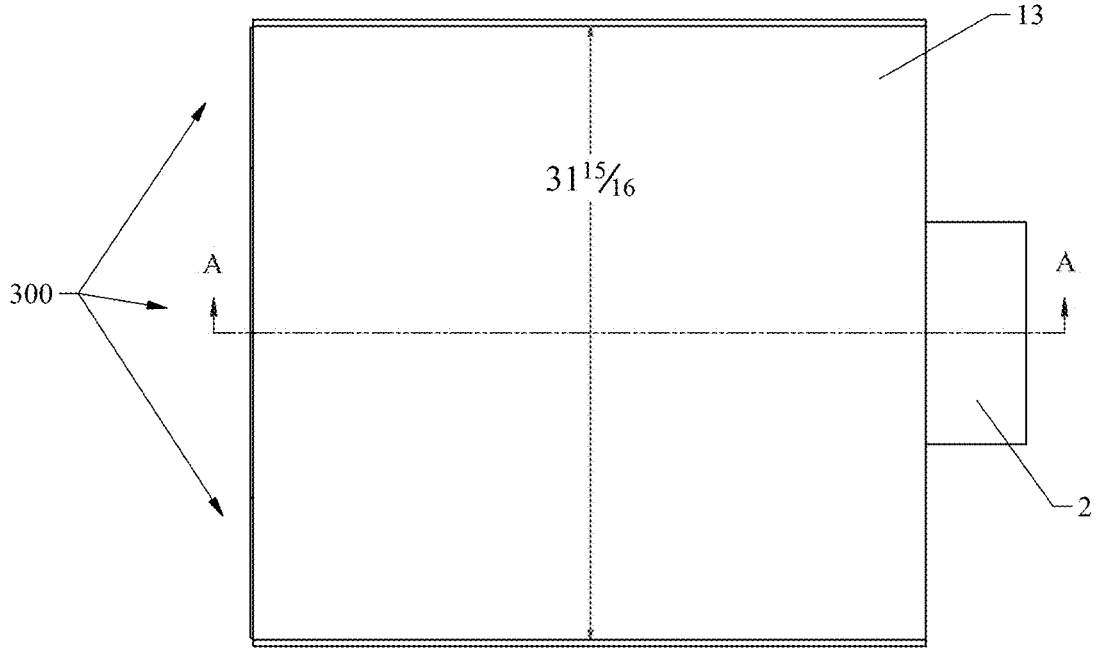
FIGS. 6*a-b* show various views of the laminar flow box assembly with general dimensions according to an embodiment of the present invention.
Figure 6:
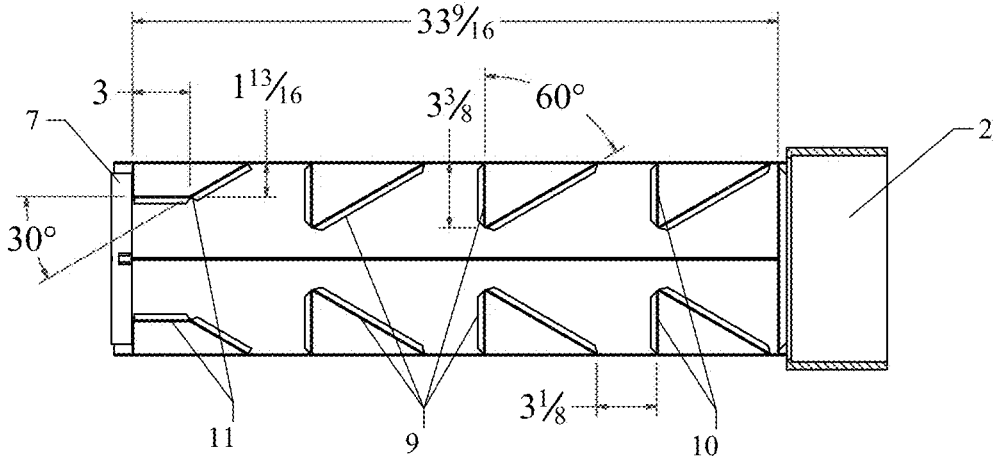

FIGS. 6*a-b* show various views of a preferred embodiment of the laminar flow box assembly 300 with general dimensions according to an embodiment of the present invention. FIG. 6*a* shows a top view of the laminar flow box assembly 300 with the shell 13, and the PVC inlet coupler 2. FIG. 6*b* shows right side cutaway view of the laminar flow box assembly 300 along A-A of FIG. 6*a*. with example general dimensions and angles in degrees of the flow laminators as are arranged in a preferred embodiment of the laminar flow box. Top and bottom ramp laminators 9, ramp laminators 10, ramp laminators 11, the PVC inlet coupler 2, and the outlet grate 7 are shown. The preferrable range of the angle of the ramp laminators is 15 to 45 degrees relative to the flow of the incoming water.

Figure 7:
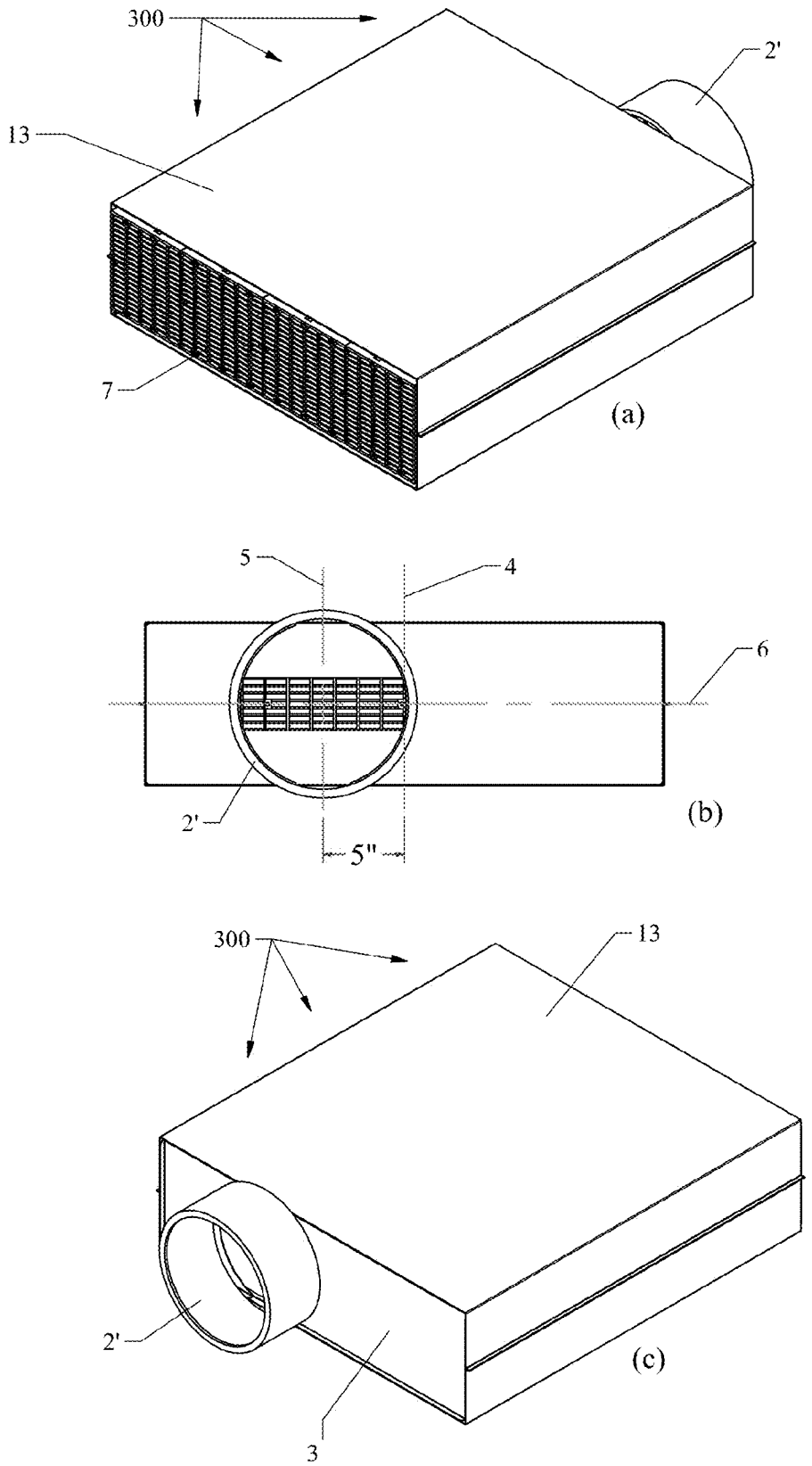
FIGS. 7*a-c* show a front right view, back view, and a back left view, respectively, of the laminar flow box assembly according to an embodiment of the present invention.

FIG. 7*a-c* show a front right view, back view, and a back left view, respectively, of an alternative preferred embodiment of the laminar flow box assembly 300 according to an embodiment of the present invention. FIG. 7*a* shows the shell 13, the PVC inlet coupler 2', and the outlet grate 7. The offset inlet coupler 2' design shown in this figure, and in FIG. 3*g*, is a modification of the laminar flowbox assembly 300 shown in FIGS. 3 *a-f*. This offset inlet coupler 2' design can be used to properly laminate water that is entering the flowbox when, for example, a 90 degree fitting is located within 48" of the inlet coupling. This is applicable, for example, when a 90 degree fitting is perpendicular to the laminar flow of water exiting the flowbox. FIG. 7-*b* shows the offset inlet coupler 2' design with a vertical centerline 5 as compared to FIGS. 3 *a-f* inlet coupler 2 with a vertical centerline 4. Horizontal centerline 6 is typical for inlet coupler 2 in FIG. 3 *a-f* and offset inlet coupler 2' in FIG. 7 *a-c*.

Figure 8:
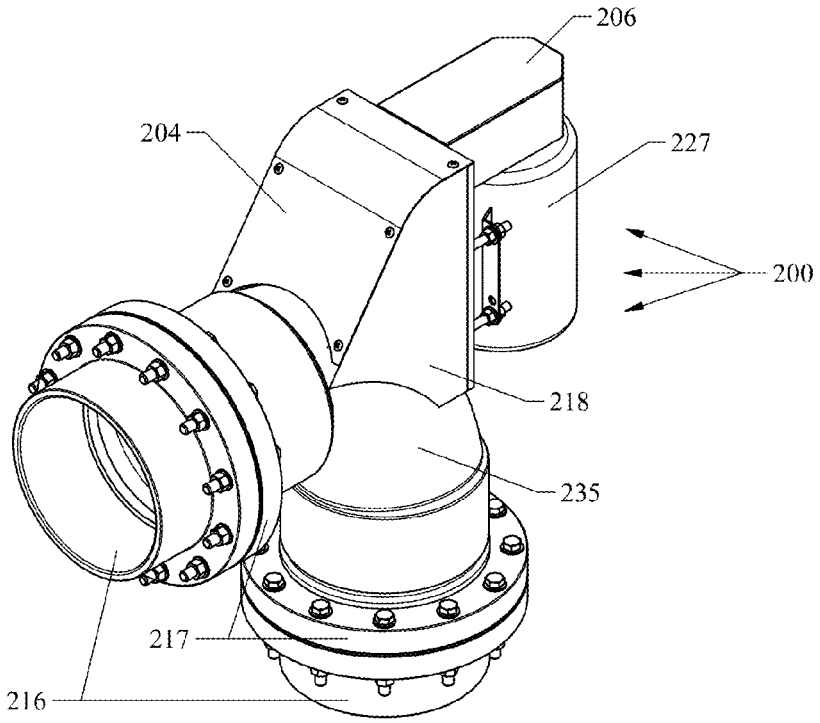
FIGS. 8*a-b* show a front right view and a back left view, respectively, of an assembled axial flow water pump assembly according to an embodiment of the present invention.
Figure 8:
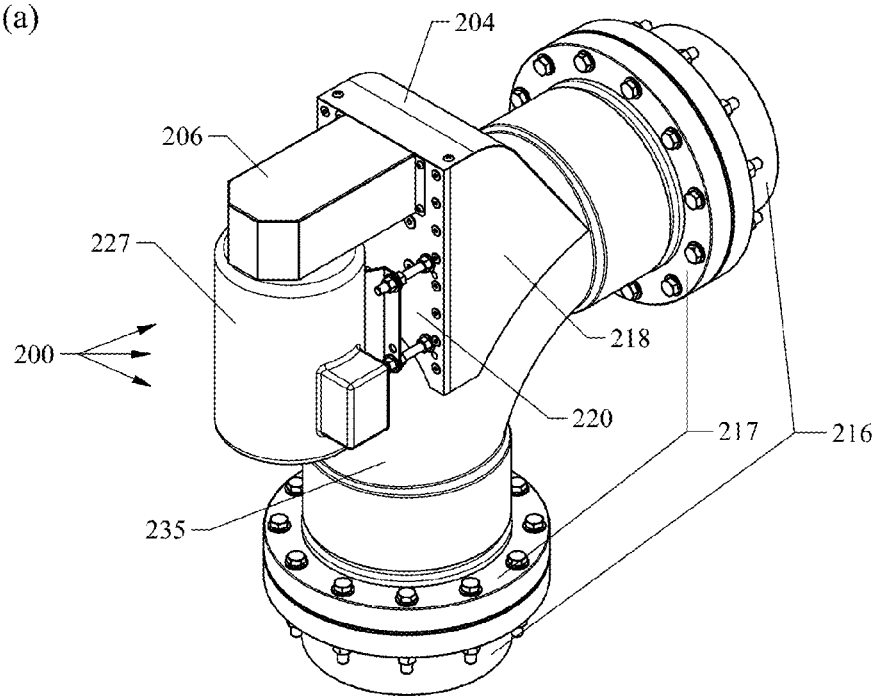
Figure 9:
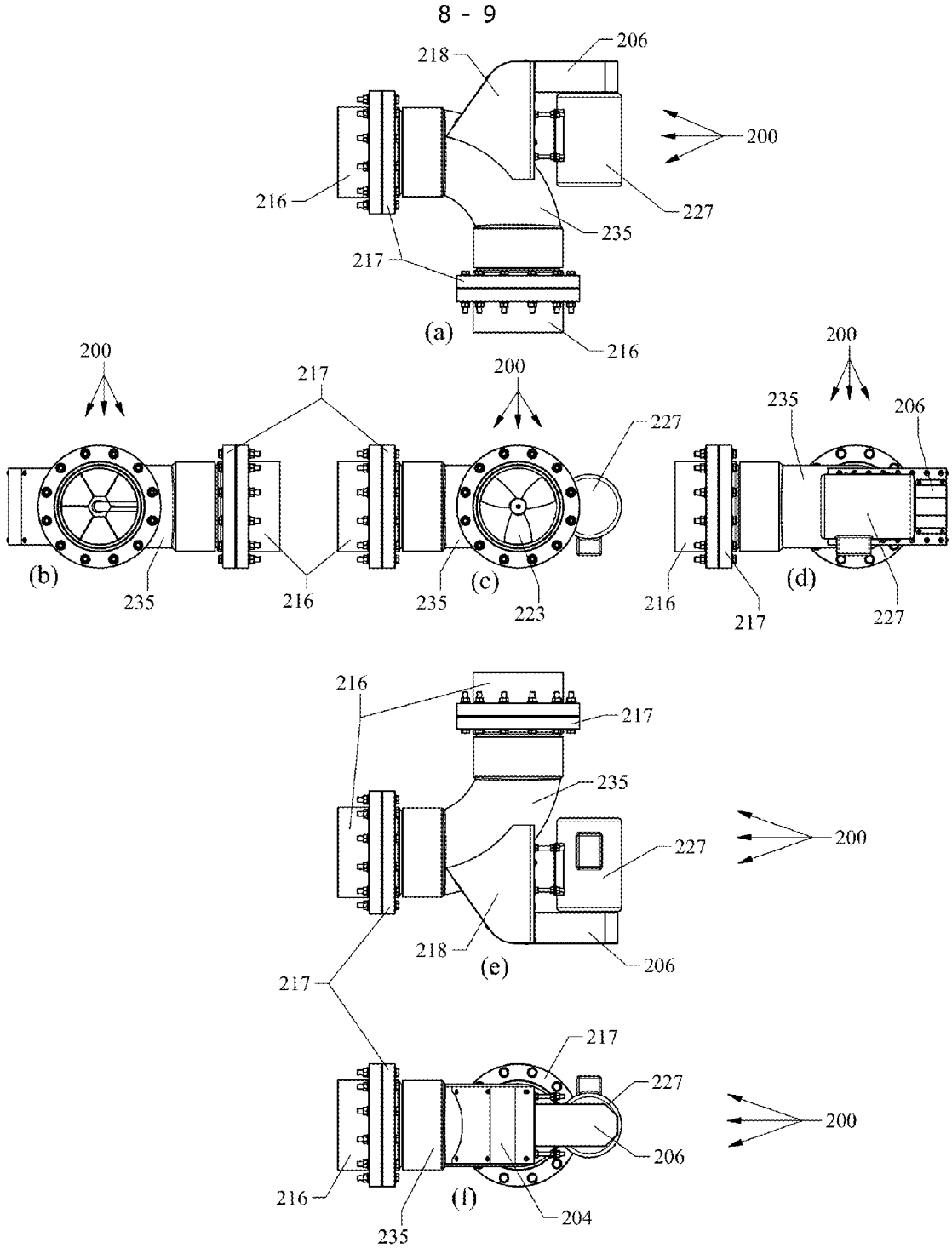
FIGS. 9*a-f* show various views of the axial flow water pump assembly including a top view, a back view, left and right views, and inlet and outlet views according to an embodiment of the present invention.

FIGS. 8*a-b* show a front right view and a back left view, respectively, of an assembled axial flow water pump assembly 200 according to an embodiment of the present invention. These views show various parts of the axial flow water pump assembly 200 including the bearing cover 204, belt cover 206, Van Stone flanges 216 and 217, motor frame mounts 218, motor frame plate 220, motor 227, and pump body 235.

FIGS. 9*a-f* show various views of the axial flow water pump assembly 200 including a top view, a back view, left and right views, and inlet and outlet views according to an embodiment of the present invention. These views show various parts of the axial flow water pump assembly 200 including the bearing cover 204, belt cover 206, Van Stone flanges 216 and 217, motor frame mounts 218, propeller 223 (e.g., Kaplan type as described above), motor 227, and pump body 235.

Figure 10:
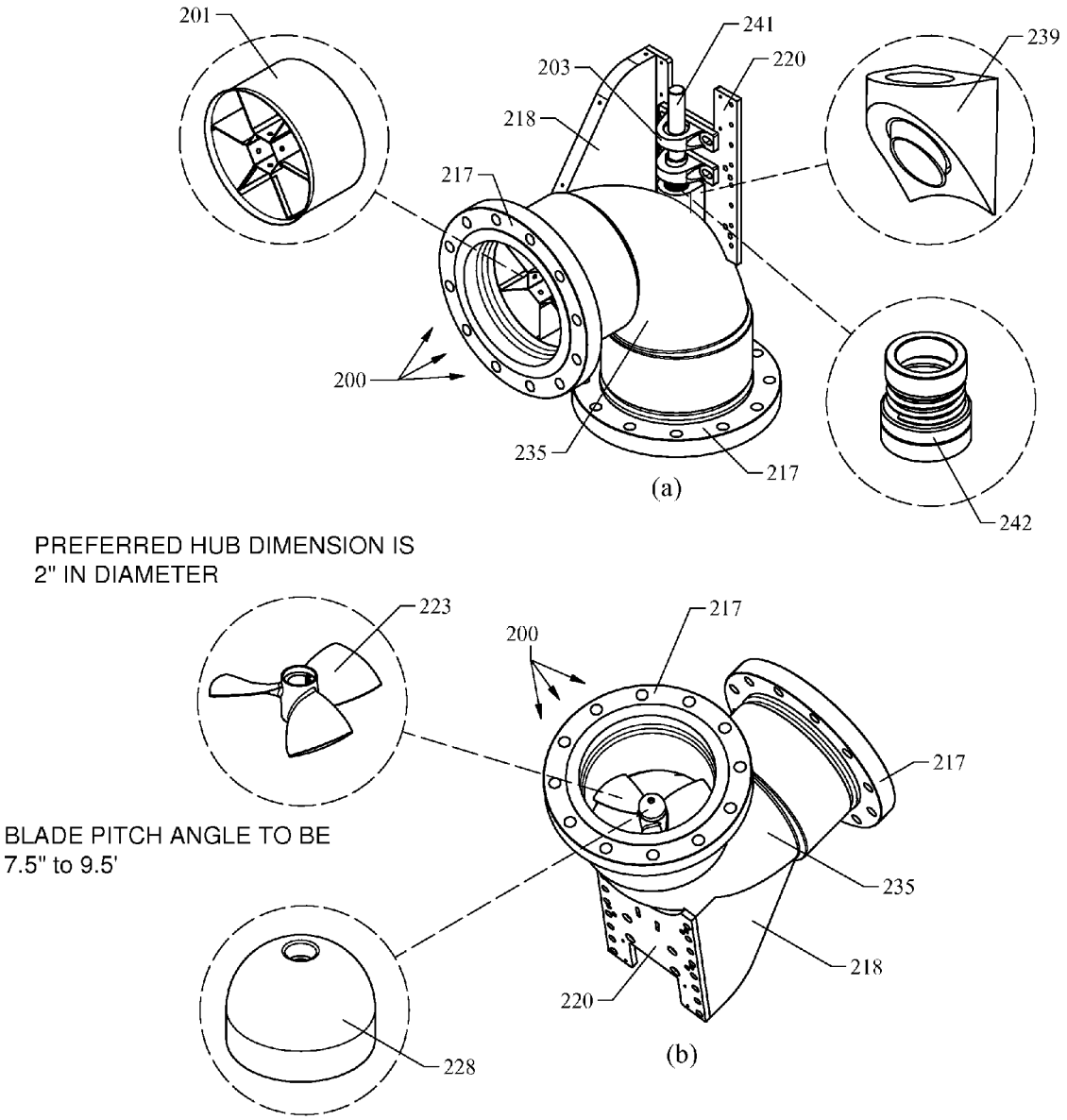
FIGS. 10*a-b* show a left front view and a right rear view, respectively, of an axial flow water pump assembly (with certain portions shown isolated in circled windows for clarity) according to an embodiment of the present invention.

FIGS. 10*a-b* show a left front view and a right rear view, respectively, of an axial flow water pump assembly 200 (with certain portions shown isolated in circled windows for clarity) according to an embodiment of the present invention. Individual components of the axial flow water pump assembly 200 shown in FIG. 10 include, but are not limited to, ball bearing pillow block 203, Van Stone flanges 217 (allows for easy installation and removal of the pump), motor frame mounts 218, motor frame plate 220, propeller 223 (e.g., Kaplan type), nose cone 228, pump body 235, axial flow straightener 201, seal carrier 239, propeller shaft 241, and seal shaft 242. As shown, the pump body is bent between the flanges 217 (e.g., Van Stone style) at about 90°. This unique structural design increases flow efficiency, decreases turbulence, smoothes out exiting water flow, and cuts down on cavitation, and preferably no cavitation is created (as opposed to the related art). The connection of the nose cone 228 to the propeller 223 is also unique in that it is physically attached to the propeller. Additionally, the seal carrier's 239 structural design is unique, as it has a concave base to fit the approximately 90° bend of the pump body 235. Seal shaft 242 at lease partially fits into the top of the seal carrier 239, and together these elements keep the pump from leaking at the pump shaft.

Figure 11:
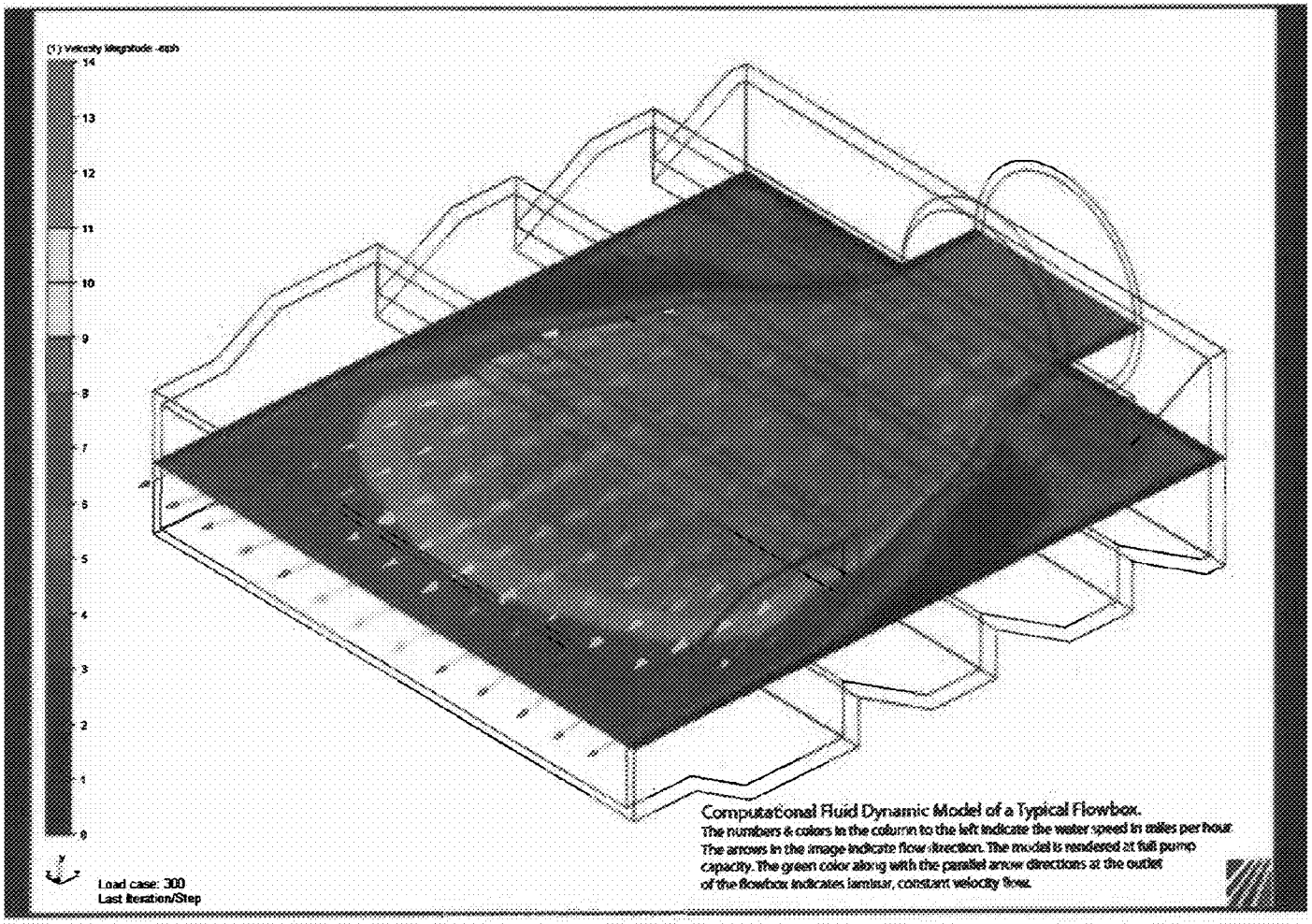
FIG. 11 shows a computational fluid dynamic model of a laminar flow box assembly according to an embodiment of the present invention.

FIG. 11 shows a computational fluid dynamic model of a laminar flow box assembly according to an embodiment of the present invention. The numbers and colors in the column to the left of the model illustration indicate the water speed in miles per hour. The arrows in the image indicate flow direction. The model is rendered at full pump capacity. The green color along with the parallel arrow directions at the outlet of the flowbox indicates laminar, constant velocity flow.

Figure 12A:
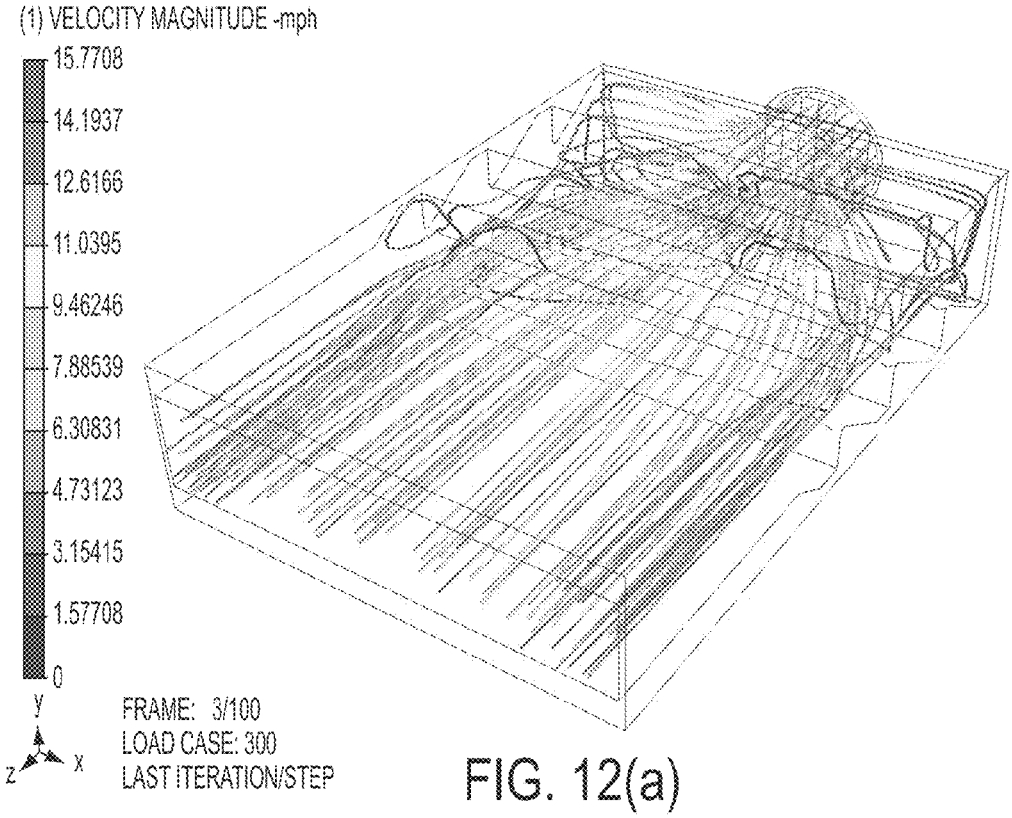
FIGS. 12*a-b* are screenshots of the computational fluid dynamic model analysis, as shown in FIG. 11, according to an embodiment of the present invention.
Figure 12B:
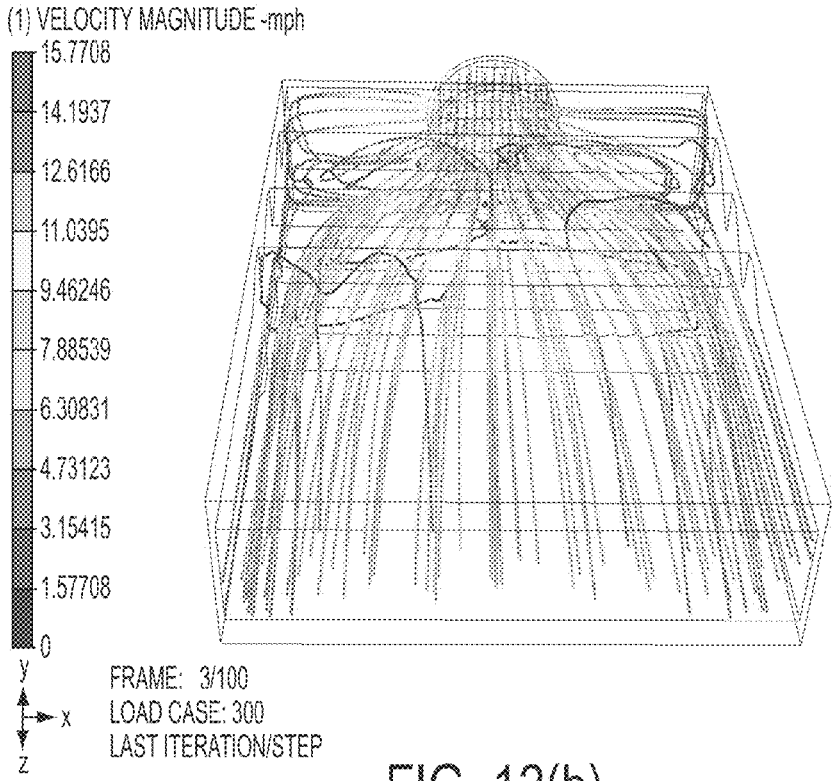

FIGS. 12*a-b* are screenshots of a computational fluid dynamic model ("CFD") analysis, as shown in FIG. 11, according to an embodiment of the present invention. These screenshots of the CFD analysis show how water flow from a feed pipe is distributed inside the flowbox and ultimately exits as a laminar flow. These screenshots are a CFD particle trace showing the objective of the flowbox; to convert the water flow entering the flow box from a pipe (e.g., 10") into a balanced pressure gradient laminar flow exiting out through the grates (grates not shown).

Figure 13A:
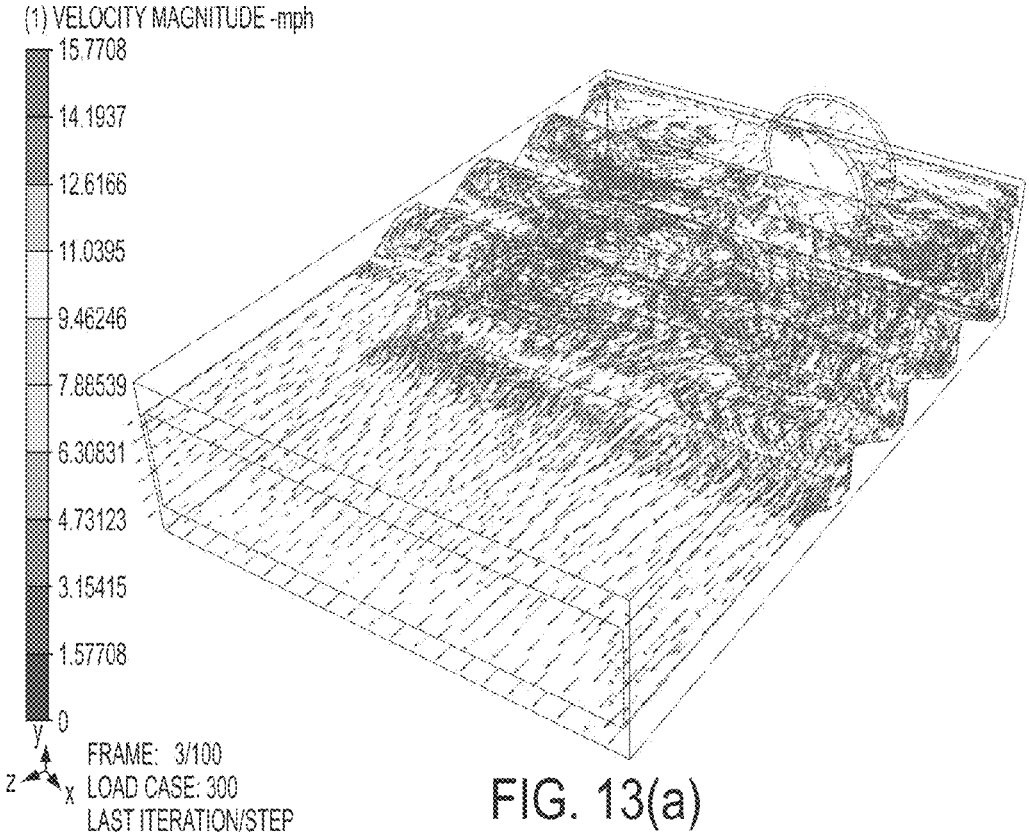
FIGS. 13*a-b* are screenshots of a CFD process that analyzes the creation of laminar flow in the laminar flow box assembly according to an embodiment of the present invention.
Figure 13B:
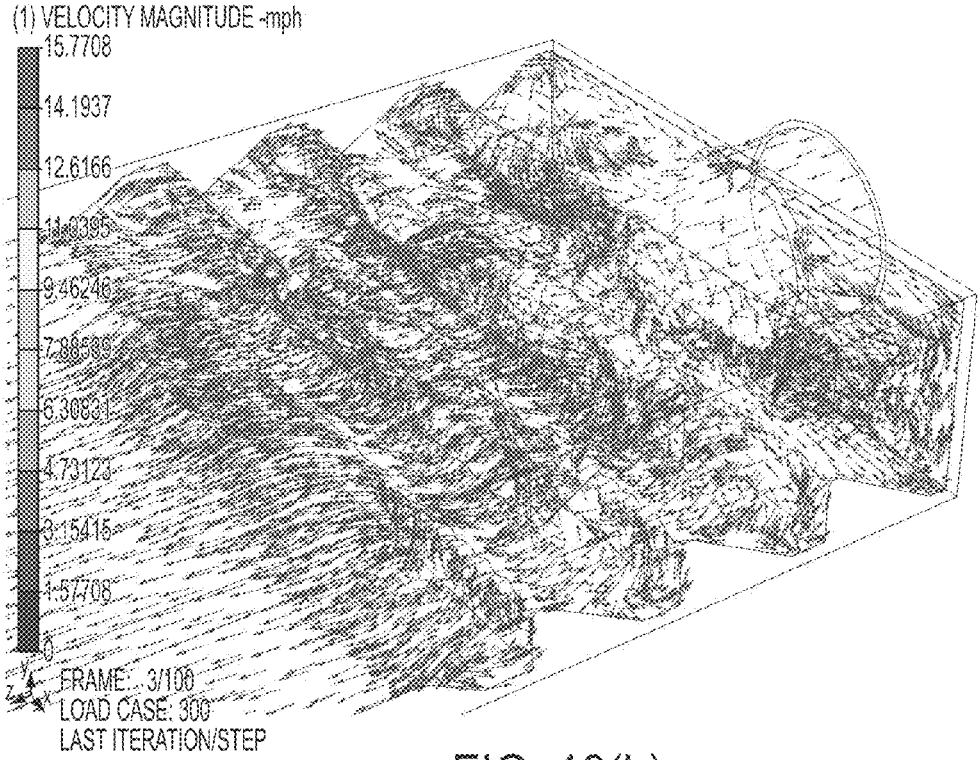

FIGS. 13*a-b* are screenshots of a CFD process that analyzes the creation of laminar flow in the laminar flow box assembly according to an embodiment of the present invention. The water enters the flow box from the feed pipe (e.g., 10") and encounters the first "ramp" laminar, the ramp's purpose is to redirect the higher pressure flow towards areas of lower pressure, this redirection creates turbulence & balances the dynamic pressures across the cross sectional area of the flow box. As the flow progresses down the length of the flowbox, it will encounter 3 more ramps in this embodiment. Each successive ramp distributes the pressures and adds direction to the flow until the pressures are evenly balanced and the turbulence vectors are on the same YZ plane, at which point the flow is considered laminar and is sent through the grates into a therapy pool, for example.

Figure 14:
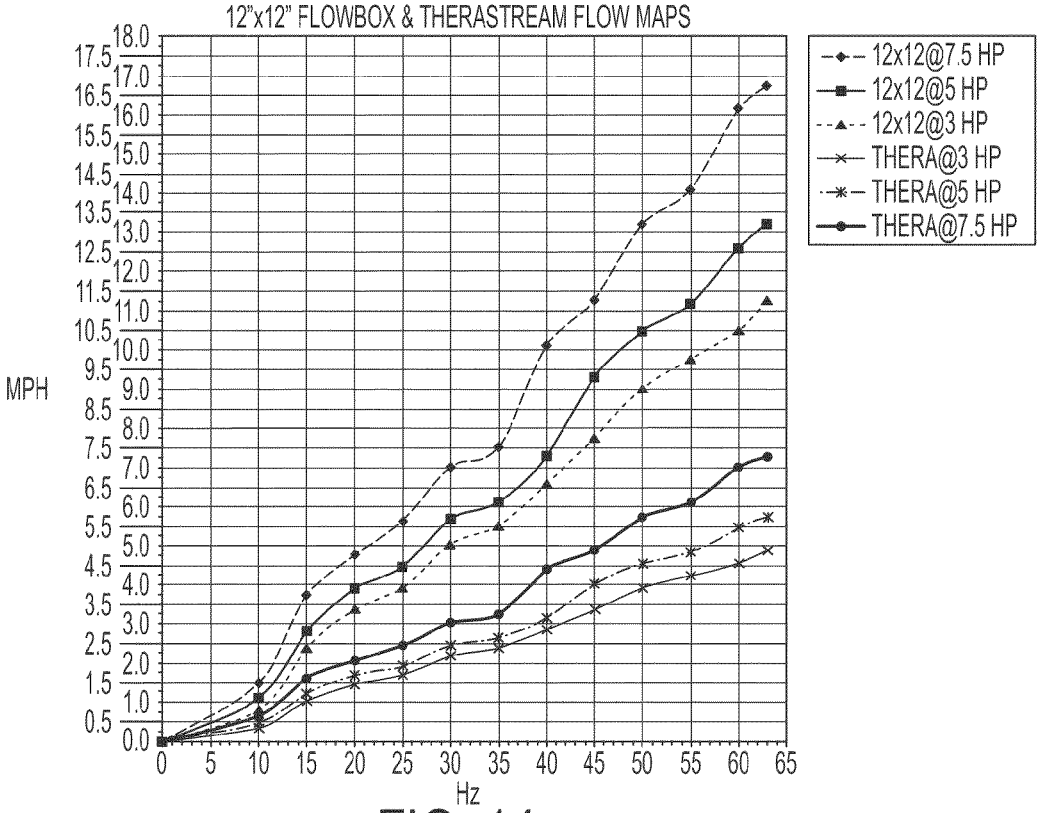
FIG. 14 shows tabulated data and a graph relating to a 12×12 flowbox with grates and no ramp laminators, and a "TheraStream" flowbox with grates and ramp laminators according to an embodiment of the present invention.

FIG. 14 shows tabulated data and a graph relating to a 12×12 flowbox with grates and no ramp laminators, and a "TheraStream" flowbox with grates and ramp laminators according to an embodiment of the present invention. Tests were run on each flowbox with different sized pumps including 3 hp, 5 hp, and 7.5 hp. The column labeled "HZ" refers to the AC frequency of the power that is supplied to the pump motor. This can be interpreted as the speed of the motor/propeller. The column labeled "MPH" refers to the nominal speed of the water in miles per hour at the grates of the respective flowbox. The speed of the water at the grates has been calculated mathematically from empirical data gathered from a disk-type flowmeter placed directly in the supply pipe. The 12×12 flowbox has no further tests that were run. It is not intended to be a true laminar flowbox, unlike the TheraStream flowbox, which has extensive CFD analysis and empirical testing performed. The significance of the tabulated data will give the end user the information needed to select the proper motor horsepower for their needs. It will also serve as a reference guide for a therapist, for example, in their application.

While the invention is susceptible to various modifications, and alternative forms, specific examples thereof have been shown in the drawings and are herein described in detail. It should be understood, however, that the invention is not to be limited to the particular forms, sizes, or methods disclosed, but to the contrary, the invention is to cover all modifications, equivalents and alternatives falling within the spirit and scope of the disclosed invention.

DEFINITIONS

Any and all published documents mentioned herein shall be considered to be incorporated by reference, in their respective entireties, herein to the fullest extent of the patent law. The following definitions are provided for claim construction purposes:

Present invention: means at least some embodiments of the present invention; references to various feature(s) of the "present invention" throughout this document do not mean that all claimed embodiments or methods include the referenced feature(s).

First, second, third, etc. ("ordinals"): Unless otherwise noted, ordinals only serve to distinguish or identify (e.g., various members of a group); the mere use of ordinals implies neither a consecutive numerical limit nor a serial limitation.

Embodiment: a machine, manufacture, system, process and/or composition that may (not must) meet the embodiment of a present, past or future patent claim based on this patent document; for example, an "embodiment" might not be covered by any claims filed with this patent document, but described as an "embodiment" to show the scope of the invention and indicate that it might (or might not) covered in a later arising claim (for example, an amended claim, a continuation application claim, a divisional application claim, a reissue application claim, a re-examination proceeding claim, an interference count); also, an embodiment that is indeed covered by claims filed with this patent document might cease to be covered by claim amendments made during prosecution.

Electrically Connected: means either directly electrically connected, or indirectly electrically connected, such that intervening elements are present; in an indirect electrical connection, the intervening elements may include inductors and/or transformers.

Mechanically connected: Includes both direct mechanical connections, and indirect mechanical connections made through intermediate components; includes rigid mechanical connections as well as mechanical connection that allows for relative motion between the mechanically connected components; includes, but is not limited, to welded connections, solder connections, connections by fasteners (for example, nails, bolts, screws, nuts, hook-and-loop fasteners, knots, rivets, quick-release connections, latches and/or magnetic connections), force fit connections, friction fit connections, connections secured by engagement caused by gravitational forces, pivoting or rotatable connections, and/or slidable mechanical connections.

To the extent that the definitions provided above are consistent with ordinary, plain, and accustomed meanings (as generally shown by documents such as dictionaries and/or technical lexicons), the above definitions shall be considered supplemental in nature. To the extent that the definitions provided above are inconsistent with ordinary, plain, and accustomed meanings (as generally shown by documents such as dictionaries and/or technical lexicons), the above definitions shall control. If the definitions provided above are broader than the ordinary, plain, and accustomed meanings in some aspect, then the above definitions shall be considered to broaden the claim accordingly.

To the extent that a patentee may act as its own lexicographer under applicable law, it is hereby further directed that all words appearing in the claims section, except for the above-defined words, shall take on their ordinary, plain, and accustomed meanings (as generally shown by documents such as dictionaries and/or technical lexicons), and shall not be considered to be specially defined in this specification. In the situation where a word or term used in the claims has more than one alternative ordinary, plain and accustomed meaning, the broadest definition that is consistent with technological feasibility and not directly inconsistent with the specification shall control.

Unless otherwise explicitly provided in the claim language, steps in method steps or process claims need only be performed in the same time order as the order the steps are recited in the claim only to the extent that impossibility or extreme feasibility problems dictate that the recited step order (or portion of the recited step order) be used. This broad interpretation with respect to step order is to be used regardless of whether the alternative time ordering(s) of the claimed steps is particularly mentioned or discussed in this document.

What is claimed is:

1. A propulsion system comprising:
an axial flow water pump assembly comprising:
a pump body;
an inlet end;
an outlet end;
a propeller housed within the inlet end; and
an axial vane flow straightener housed within the outlet end structured to straighten axial rotation of water arriving at said axial vane flow straightener downstream of said propeller, wherein said axial vane flow straightener further comprises a cylindrical housing, a non-cylindrical hub portion stretching along said cylinder's longitudinal axis, and at least one planar-shaped plate longitudinally attached to said hub portion.

2. The propulsion system of claim 1, wherein said non-cylindrical hub portion is hexagonal.

3. The propulsion system of claim 1, wherein said propeller is a ducted propeller.

4. The propulsion system of claim 3, wherein said ducted propeller further comprises at least one structurally non-planar blade with twists along said blade's length so as to create an axial thrust of water as the water exits said ducted propeller.

5. The propulsion system of claim 4, wherein said at least one structurally non-planar blade comprises about a 7.5" to 9.5" blade pitch.

6. The propulsion system of claim 5, wherein said ducted propeller comprises a less than 4" hub diameter.

7. The propulsion system of claim 6, wherein said ducted propeller comprises a less than 2" hub diameter.

8. The propulsion system of claim 7, wherein said ducted propeller comprises a nose cone attached to the outlet end of said hub.

9. The propulsion system of claim 1, wherein said pump body comprises a bend between said inlet and outlet ends.

10. The propulsion system of claim 9, wherein said bend is about 90 degrees.

11. The propulsion system of claim 9, further comprising a seal carrier comprising a concave base configured to attach to the outside of the bent portion of the pump body, and to assist with the prevention of leaks from the pump body.

12. A propulsion system downstream from a propeller comprising:
a laminar flow box assembly comprising:
a housing;
an inlet end;
an outlet end;
an outlet grate attached to said outlet end of said housing;
an inlet coupler attached to said inlet end of said housing; and
at least a first ramp laminator housed within said housing and structured to provide at least partial laminar water flow at said outlet end.

13. The propulsion system of claim 12, wherein said at least a first ramp laminator is positioned along the width of said laminar flow box assembly.

14. The propulsion system of claim 13, further comprising a second ramp laminator housed within said housing and positioned along the width of said laminar flow box assembly, wherein said first ramp laminator is attached to the interior top portion of the housing and said second ramp laminator is attached to the interior bottom portion of the housing, wherein water is able to flow from said inlet end to said outlet end between said first ramp laminator and said second ramp laminator.

15. The propulsion system of claim 14, wherein said outlet end of said first ramp laminator and said second ramp laminator is about perpendicular to the flow of water, and said inlet end of said first ramp laminator and said second ramp laminator is at an angle to the flow of water.

16. A propulsion system comprising:
an axial flow water pump assembly comprising: a pump body; an inlet end; an outlet end; a propeller housed within the inlet end; and an axial vane flow straightener housed within the outlet end structured to straighten axial rotation of water arriving at said axial vane flow straightener downstream of said propeller; and
a laminar flow box assembly mechanically connected to said outlet end of said axial flow water pump assembly comprising: a housing; an inlet end; an outlet end; an outlet grate attached to said outlet end of said housing; an inlet coupler attached to said inlet end of said housing; and at least a first ramp laminator housed within said housing and structured to provide at least partial laminar water flow at said outlet end.

17. The propulsion system of claim 16, wherein said outlet grate is connected to a first end of a pool and said inlet coupler is connected to an end of a first pipe, the other end of which is connected to said outlet end of said axial flow water pump assembly.

18. The propulsion system of claim 17, wherein said inlet end of said axial flow water pump assembly is connected to an end of a second pipe, the other end of which is connected to a second end of said pool.

19. The propulsion system of claim 18, wherein said laminar flow box assembly is structured to provide a pure laminar water flow at said outlet end.

20. The propulsion system of claim 19, wherein said propeller is a ducted propeller.

* * * * *